United States Patent [19]

Donoghue

[11] Patent Number: 4,473,162

[45] Date of Patent: Sep. 25, 1984

[54] CHILD-PROOF CLOSURE ASSEMBLY

[76] Inventor: Robert J. Donoghue, 4 Burnwood Dr., Bloomfield, Conn. 06002

[21] Appl. No.: 425,546

[22] Filed: Sep. 28, 1982

[51] Int. Cl.[3] ..... B65D 55/02
[52] U.S. Cl. ..... 215/209
[58] Field of Search ..... 215/209, 216

[56] References Cited

U.S. PATENT DOCUMENTS

| | | | |
|---|---|---|---|
| 3,101,856 | 8/1963 | Whiteman, Jr. | 215/209 |
| 4,036,385 | 7/1977 | Morris | 215/209 |
| 4,099,639 | 7/1978 | Boxer et al. | 215/209 |
| 4,103,797 | 8/1978 | Morris | 215/209 |

FOREIGN PATENT DOCUMENTS

| | | | |
|---|---|---|---|
| 1527812 | 10/1978 | United Kingdom | 215/209 |

*Primary Examiner*—George T. Hall
*Attorney, Agent, or Firm*—A. W. Breiner

[57] ABSTRACT

This invention relates to a child-proof closure assembly for containers. It particularly relates to an interlocking lug on the container neck finish and one of a plurality of detents on the lower skirt portion of a closure member. The locking lug is carried by the tubular neck portion of the neck finish, and is moved to a releasing position by being integrally formed with a radially inwardly reduced thickness portion of the tubular neck portion wherein when the lug is radially inwardly depressed the reduced thickness neck portion will radially deflect to permit movement of the lug to a releasing position.

13 Claims, 10 Drawing Figures

CHILD-PROOF CLOSURE ASSEMBLY

This invention relates in general to new and useful improvements in child-proof closures assemblies for containers, and more particularly to an interlocking lug and detent combination on the container neck finish and a closure member skirt which may be released to permit unscrewing of the closure member from the associated container neck finish threads.

There has been developed numerous types of lug and detent interlocks between containers and closures which will prevent the reverse rotation of a closure once it has been applied unless the interlock between the lug and detent is released. This is a common child-proof feature.

While many of these combinations provide for the necessary interlock, they have the deficiency that it is even difficult for an adult to determine how to release the closure lock. Numerous release means have been provided. Typically, the interlock is at diametrically opposite points, and when the closure is squeezed it will assume an oval or oblong cross-sectional condition so as to release interlock. Attempts have been made to deform the neck finish to produce a similar release. However, in order to meet other requirements of the bottle, the neck finish must be relatively stiff.

Most particularly, a container neck finish must be of sufficient strength and stiffness to provide for top loading. Top loading is usually referred to as stacking of containers either in storage or on a store shelf, as well as the fill-nozzle pressure on the neck finish when filling the container for top pressure exerted on the neck finish when applying the closure after filling.

Normally the wall thickness in the finish area is such that it is almost impossible to deform the bottle in the neck finish area. If one attempts to squeeze the plastic bottle neck finishes of the type having external threads, one will find that it is virtually impossible to readily inwardly deform such neck finish so as to release a lug carried by the neck finish from an associated closure. Moreover, most known child-resistant closures are made up of one or more parts which have to be assembled and, accordingly, are much more expensive than conventional or so-called stock closures. Further, these closures often require special finishes or threads, and cannot be used on stock bottles.

This invention provides the wall of the tubular neck member of a container neck finish with a portion of reduced thickness, and this portion carries the usual locking lug. By so specifically constructing the neck finish, a radially inwardly directed pressure on the locking lug will result in a radially inwardly deformation or flexing of the reduced thickness area of the neck finish so as to permit the locking lug to move radially inwardly to a release position.

Another feature of the invention is the formation of the lug with an upward camming surface to be engaged by detents of the closure member and a lower releasing portion which projects radially outwardly of the camming surface, and may be readily engaged by one's fingers below the lower edge of the closure member skirt to manually depress the lug to its released position.

A single lug may be provided or, if desired, a pair of diametrically, oppositely located lugs may be provided. Further, the lug arrangement may be utilized in conjunction with containers which have abrupt shoulders immediately below the tubular neck member wherein the shoulders overlap at least the lower releasing surface of the lug primarily providing the shoulder with a recess aligned with the lug.

The closures of this invention are inexpensive and fit standard or stock threads. The bottle finish wall is thinned down to a point where the locking lug can be flexed or deformed just enough to release the ratchet. When the cap or closure is rotated about ½ to 1 full turn, the ratchet teeth will be above the ratchet where the lug does not need to be flexed any longer to finish removing the cap. A minor change in the finish wall thickness still provides a leakproof bottle. The child-proof bottle can be easily opened by an adult with arthritic, or the like, hands and relocked.

Having described the invention in general terms, specific and presently preferred embodiments will be set forth in the context of the illustrative drawing.

Figure 1:
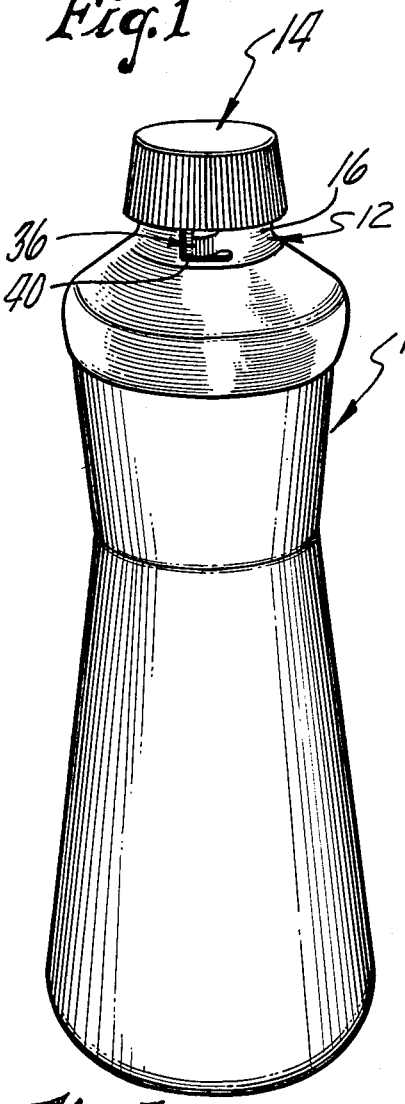
FIG. 1 is a conventional plastic bottle wherein the neck finish is provided with a locking lug in accordance with the invention, the bottle being closed by a screw-threaded closure member.

Referring now to the drawing in detail, it will be seen that there is illustrated a conventional type of plastic bottle, generally identified by the numeral 10. The bottle 10 is provided at its upper end with a neck finish 12 on which there is threadedly engaged a closure 14.

Figure 2:
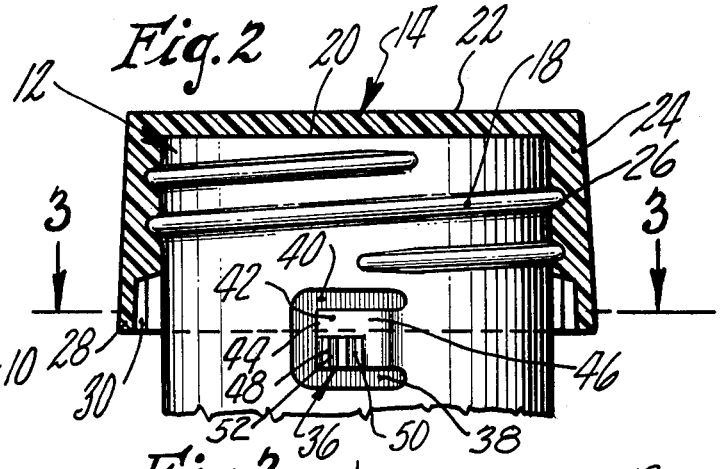
FIG. 2 is an enlarged fragmentary elevational view of the neck finish of the bottle of FIG. 1, with the closure member broken-away and shown in sections so as to clearly illustrate the details of the locking lug.

Referring now to FIG. 2 in particular, it will be seen that the neck finish 12 includes a tubular neck portion 16 having projecting radially outward therefrom conventional threads 18. The tubular neck portion 16 terminates in a sealing edge 20.

The closure member 14 is of the conventional type and includes an end wall 22 and a detenting skirt 24. The inner surface of the skirt 24 has formed therein threads 26 which cooperate with the threads 18 so that the closure member 14 may be applied to the neck finish 12 by rotation and may be removed in the same manner.

This invention in no way relates to the neck finish 12 or the closure member 14 as described.

Figure 3:
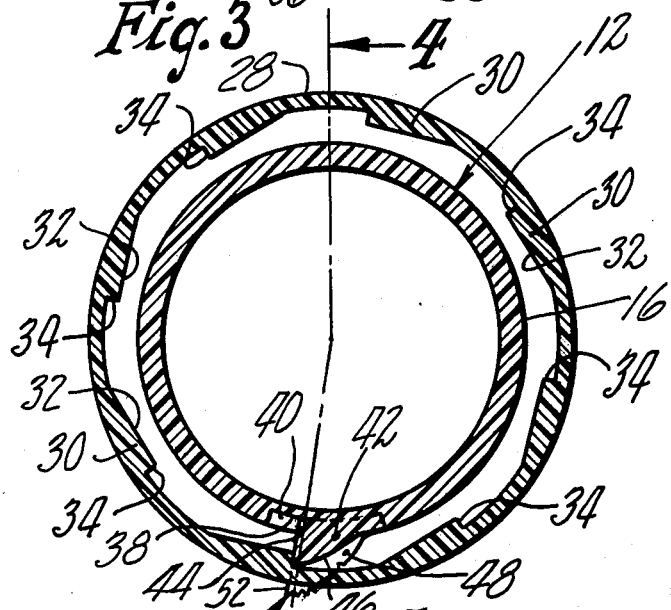
FIG. 3 is a transverse sectional view taken generally along the line 3—3 of FIG. 2, and more specifically illustrates the relationship of the locking lug with respect to a detent carried by the lower skirt portion of the closure member.

The closure member 14 has a lower skirt portion 28 disposed below the thickened wall portion in which the threads 26 are formed. A plurality of circumferentially spaced, radially inwardly projecting detents 30 are formed integral with the lower skirt portion 28, as is best shown in FIG. 3.

Each detent 30 has an inner camming surface 32 and terminates in a locking face 34 which faces circumferentially in the direction opposite to the direction of rotation of the closure member 14 to apply the same.

Figure 6:
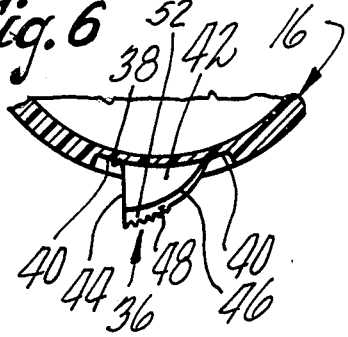
FIG. 6 is an enlarged fragmentary horizontal sectional view taken generally along the line 6—6 of FIG. 5 and shows further the details of the locking lug.

Most particularly, this invention relates to the provision of a locking lug on the neck finish 12. The locking lug is generally identified by the numeral 36, and is integrally connected to a radially inwardly recessed outer surface 38 of the tubular neck portion 16 which, as is best shown in FIG. 6, is formed by a radially inwardly thinning of the wall of the tubular neck portion 16 as at 40.

The lug 36 is of a one-piece construction and includes an upper portion 42 which is provided at a free end thereof with a circumferentially facing locking surface 44. The locking surface 44 faces in the same circumferential direction as the direction of rotation of the closure member 14 when it is being applied and, thus, opposes the surface 34 of each detent 30.

The upper portion 42 also includes a radially outer camming surface 46 which will engage the camming surface 32 of the detents 30 so that the lug 36 may ride over the detents when the closure member is being applied.

Each lug 36 is also provided with a lower portion 48 which projects radially outwardly beyond the upper portion 42. If desired, a portion of the outer surface of the lower portion 48 may be roughened as at 50 to facilitate engagement by one's finger.

Figure 4:
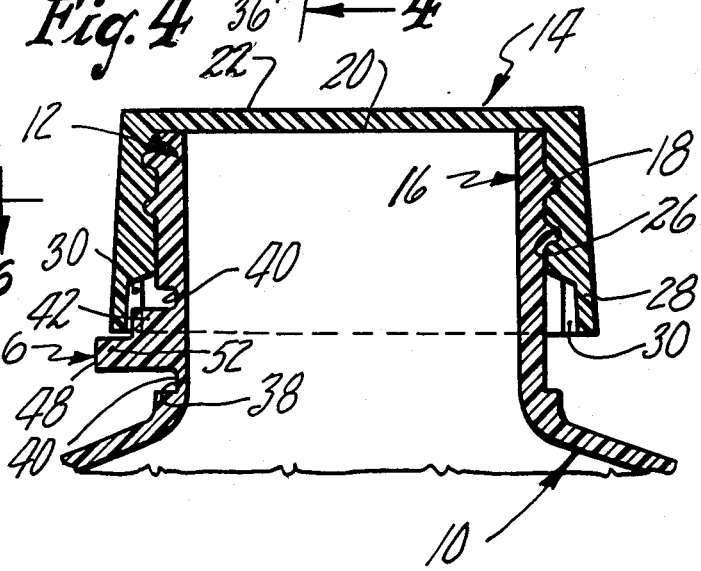
FIG. 4 is a fragmentary vertical sectional view taken generally along the line 4—4 of FIG. 3, and shows specifically the cross-section of the locking lug and the relationship thereof with respect to the lower skirt portion of the closure member.
Figure 5:
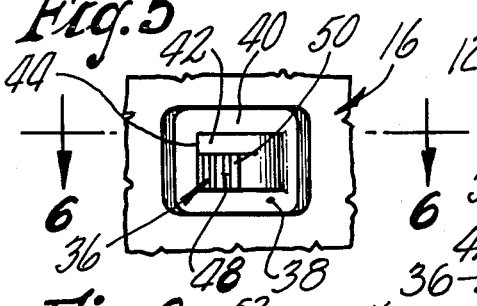
FIG. 5 is an enlarged fragmentary elevational view showing more specifically the details of the locking lug wherein the reduced thickness surrounds the locking lug.
Figure 9:
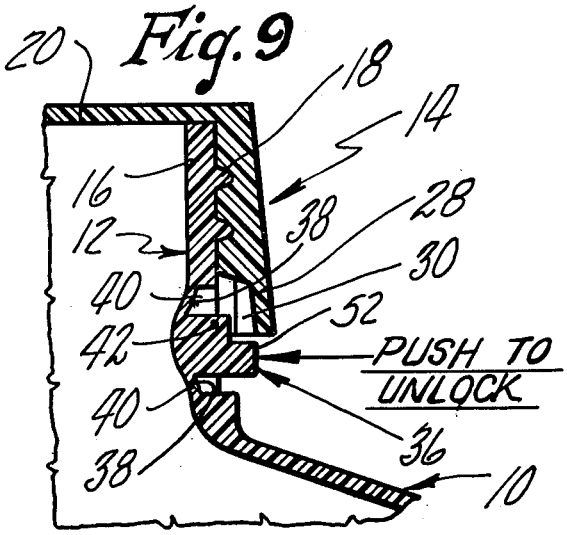
FIG. 9 is a fragmentary sectional view through the locking lug, and shows its relation to the lower skirt portion of the closure member and the manner in which the locking lug is moved to a released position.

Referring now to FIG. 4, it will be seen that when the closure cap or member 14 is applied to the neck finish 12, at such time as the closure member bottoms out against the sealing surface 20 of the neck finish, the lower edge of the lower skirt portion 28 remains spaced above the plane of the lower portion 48 of the lug 36. Thus, the lower portion 48 which has a radially outwardly projecting releasing surface 52 may be readily engaged so as to depress the lug 36 inwardly to a detent releasing position by inwardly flexing or deforming the wall portion 40, as is clearly shown in FIG. 9.

While the specifics of the wall thickness of the various portions of the tubular neck portion 16 are not critical, it is pointed out here that in a normal container construction, the customary wall thickness of the tubular neck portion 16 would be on the order of 0.030 inch to 0.060 inch, whereas the thickness of the thinned wall portion 40 would be on the order of 0.010 inch.

Figure 7:
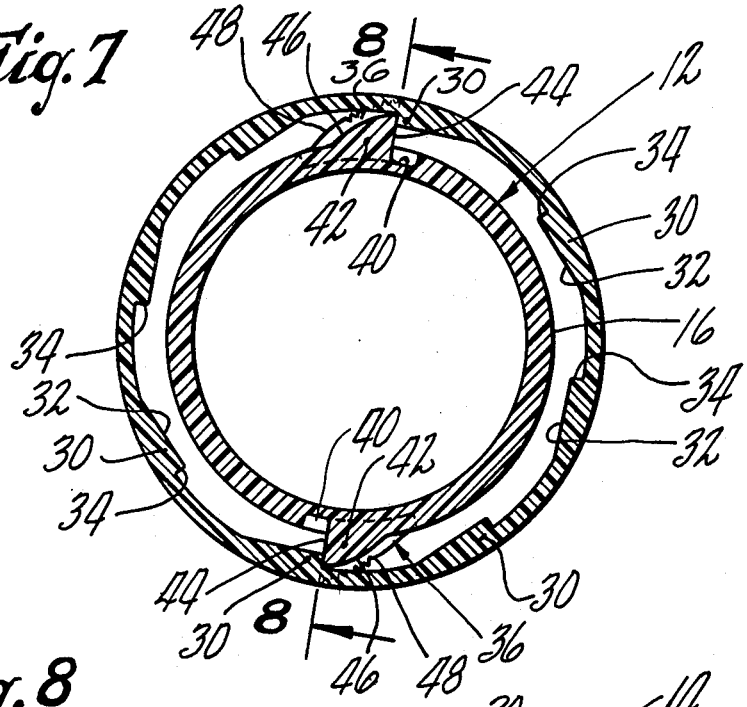
FIG. 7 is a sectional view similar to FIG. 3 showing a modified form of a neck finish which incorporates two locking lugs.
Figure 8:
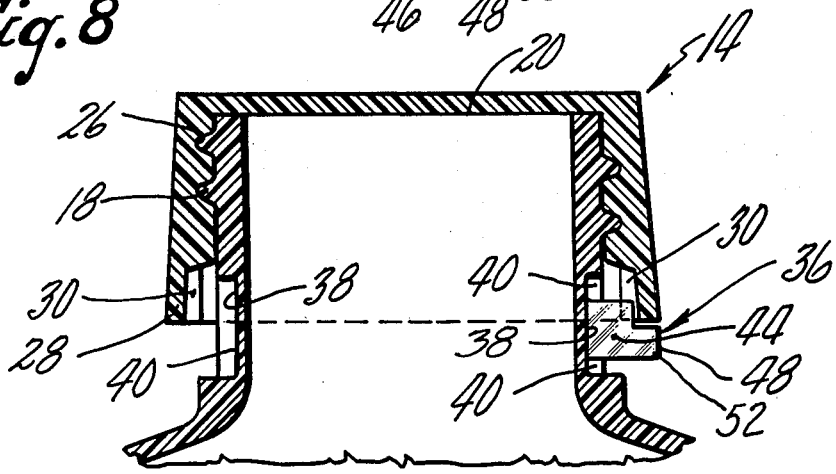
FIG. 8 is a fragmentary sectional view similar to FIG. 4 and taken along the line 8—8 of FIG. 7, and shows further the details of the neck finish.

Referring now to FIGS. 7 and 8, it will be seen that in lieu of the single lug 36 of FIGS. 1–6, the neck finish 12 may have formed on the tubular neck portion 16 two such lugs 36. The provision of the two lugs 36 would, thus, require the simultaneous radially inward depressing of the two lugs to release closure member 14.

It is to be understood that the detents 30 would be so circumferentially arranged so that the two lugs 36 will simultaneously lock behind two diametrically opposite detents 30.

Figure 10:
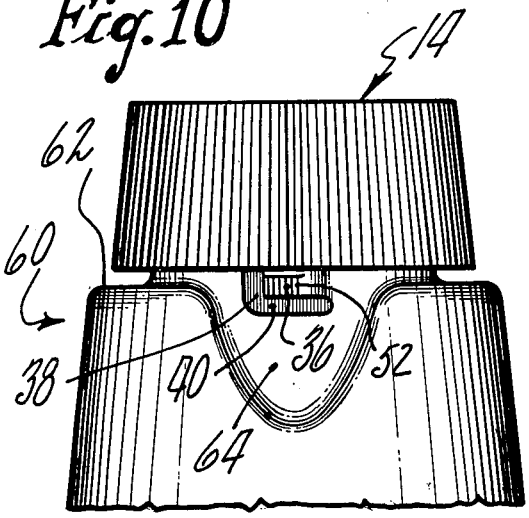
FIG. 10 is a fragmentary elevational view of a modified form of bottle wherein the bottle has a shoulder immediately below the neck finish and wherein the shoulder is provided with a recess for providing access to the locking lug to release the same.

Reference is now made to FIG. 10 wherein a special design of bottle is illustrated. This bottle, generally identified by the numeral 60, is provided with a generally square shoulder 62 which projects radially outwardly directly at the base of the tubular neck portion 16, thus the closure member 14 when applied to the neck finish 12 would be disposed closely adjacent to the upper surface of the shoulder 62 and normally prevent engagement of the lug 36 to depress the same radially inwardly to a releasing position.

In order to provide access to the lug 36, the shoulder 62 is provided with a recess 64 in alignment with the lug to provide access thereto. The recess 64 may be also shaped so that one's thumb or finger would be guided into engagement with the lug 36 to effect the releasing and movement thereof.

Although only several preferred embodiments of the invention have been specifically illustrated and described herein, it is to be understood that minor variations may be made in the neck finish and associated locking lug construction without departing from the spirit or scope of the invention as defined by the appended claims.

It is claimed:

1. A child-proof plastic material container neck finish comprising a tubular neck member having external threads for receiving a screw threaded closure, said neck finish being improved by a radially outwardly directed locking lug disposed below said external screw threads, said lug being carried by a reduced wall thickness portion of said tubular neck member wherein said lug may be radially inwardly deflected to a released position by an inward deflection of said reduced wall thickness portion.

2. A child-proof container neck finish according to claim 1, wherein said lug has a circumferentially facing locking surface and a radially outer camming surface.

3. A child-proof container neck finish according to claim 1, wherein said lug has a circumferentially facing locking surface and a radially outer upper camming surface, and a radially outwardly projecting lower releasing surface projecting radially outwardly beyond said camming surface.

4. A child-proof container neck finish according to claim 1 together with a closure member threadedly engaging said neck finish, said closure member having a lower skirt portion, radially inwardly projecting detents carried by said lower skirt portion, and said lug being engaged with one of said detents for preventing reverse rotation of said closure member on said neck finish.

5. A child-proof container neck finish according to claim 1 together with a closure member threadedly engaging said neck finish, said closure member having a lower skirt portion, radially inwardly projecting detents carried by said lower skirt portion, and said lug and locking surface being engaged with one of said detents for preventing reverse rotation of said closure member on said neck finish.

6. A child-proof container neck finish according to claim 3 together with a closure member threadedly engaging said neck finish, said closure member having a lower skirt portion, radially inwardly projecting detents carried by said lower skirt portion, and said lug being engaged with one of said detents for preventing reverse rotation of said closure member on said neck finish, said releasing surface being disposed axially below said lower skirt portion and projecting radially outwardly beyond said lower skirt portion for moving said lug to a closure member releasing position.

7. A child-proof container neck finish according to claim 4 together with a closure member threadedly engaging said neck finish, said closure member having a lower skirt portion, radially inwardly projecting detents carried by said lower skirt portion, and said lug being engaged with one of said detents for preventing reverse rotation of said closure member on said neck finish, and each of said detents having a camming surface for cooperative engagement with said lug camming surface.

8. A child-proof container neck finish in accordance with claim 1 wherein there are two of said lugs disposed in diametrically opposite relation.

9. A child-proof container neck finish in accordance with claim 1 wherein said container has an enlarged shoulder area immediately below said tubular neck member and axially overlapping said lug, and said shoulder having a recess therein aligned with said lug providing access to said lug.

10. In a child-resistant container and closure combination comprising:

a container having a body and a tubular open-ended threaded finish, a threaded closure for said finish having an angular skirt adapted to threadably engage said finish, at least one radially inwardly extending locking tooth on said angular skirt for cooperation with a pawl, the improvement comprising:

a resilient area of predetermined size molded into said finish, said resilient area having a thickness sufficiently less than that of the surrounding bottle finish to enable said resilient area to be flexed relative thereto; and a pawl for engagement with said at least one locking tooth, said pawl molded into said finish and surrounded by said resilient area sufficiently to enable radial flexing motion of said pawl between a locked outer position and an unlocked inner position.

11. A child-resistant container and closure combination according to claim 10 wherein said pawl has a portion thereof extending radially outwardly from said finish sufficiently to be accessible when said closure is in full threaded engagement with said finish, said pawl portion being pressed inwardly to move said pawl into said unlocked inner position.

12. In a child-resistant container and closure combination comprising:

a container having a body and a tubular open-ended threaded finish, a threaded closure for said finish having an angular skirt adapted to threadably engage said finish, at least one radially inwardly extending locking tooth on said angular skirt for cooperation with a pawl, the improvement comprising:

a resilient area of predetermined size molded into said finish, said resilient area having a thickness sufficiently less than that of the surrounding bottle finish to enable said resilient area to be flexed relative thereto;

a pawl for engagement with said at least one locking tooth, said pawl molded into said finish and surrounded by said resilient area sufficiently to enable radial flexing motion of said pawl between a locked outer position and an unlocked inner position; and locking lug means molded into said finish adjacent said pawl and secured thereto, said lug means extending radially outwardly from said finish sufficiently to be accessible when said closure is in full threaded engagement with said finish, said lug means being pressed inwardly for moving said pawl to said unlocked inner position to release same from engagement with said at least one locking tooth.

13. A child-proof plastic material container neck finish comprising a tubular neck member having external means for receiving a closure, said neck finish being improved by having at least one radially outwardly directed locking lug disposed thereon, said lug being carried by a reduced wall thickness portion of said tubular neck member, a release surface extending radially outwardly from said reduced wall thickness portion, wherein said lug may be radially inwardly deflected to a released position by an inward deflection of said release surface.

* * * * *